United States Patent [19]

Stroucken et al.

[11] 4,191,325

[45] Mar. 4, 1980

[54] CENTRIFUGE WITH SLUDGE OUTLETS AT ROTOR PERIPHERY

[75] Inventors: Klaus Stroucken, Ronninge; Torbjorn Winberg, Stockholm; Kaj Lindfors, Tumba, all of Sweden

[73] Assignee: Alfa-Laval AB, Tumba, Sweden

[21] Appl. No.: 932,380

[22] Filed: Aug. 9, 1978

[30] Foreign Application Priority Data

Aug. 12, 1977 [SE] Sweden ..... 7709131
Mar. 14, 1978 [SE] Sweden ..... 7802889

[51] Int. Cl.[2] ..... B04B 1/12
[52] U.S. Cl. ..... 233/20 A; 233/47 R
[58] Field of Search ..... 233/19 R, 20 R, 20 A, 233/46, 47 R

[56] References Cited

U.S. PATENT DOCUMENTS 2,087,727 7/1937 Bath ..... 233/20 A
3,777,972 12/1973 Kjellgren ..... 233/47 R

*Primary Examiner*—George H. Krizmanich
*Attorney, Agent, or Firm*—Cyrus S. Hapgood

[57] ABSTRACT

A centrifuge rotor has a first part axially displaceable into and from abutment against a second part of the rotor during operation of the centrifuge, the rotor also having peripheral outlet openings for separated sludge which are formed by and between said rotor parts. One of the rotor parts has grooves forming said outlet openings when the two parts abut each other, said parts forming a continuous opening around the periphery of the rotor when the two parts are separated from each other.

17 Claims, 12 Drawing Figures

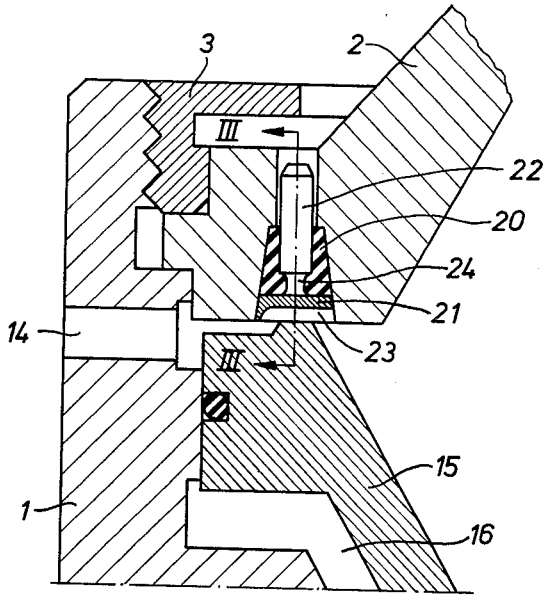
Fig. 2
Fig. 3
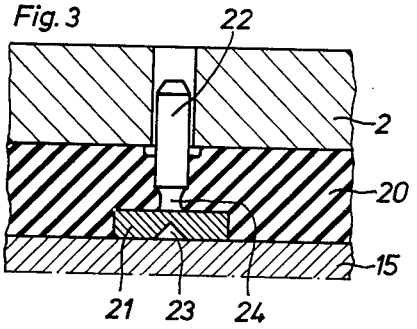
Fig. 6
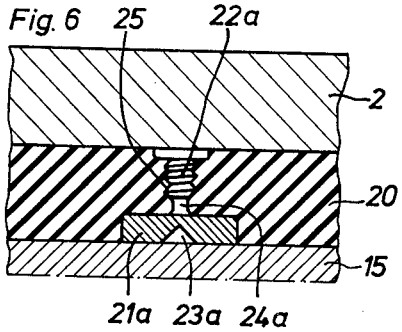
Fig. 4
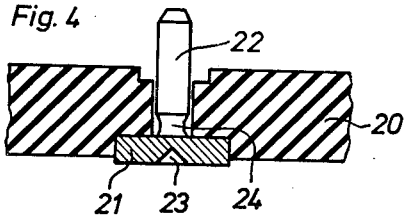
Fig. 7
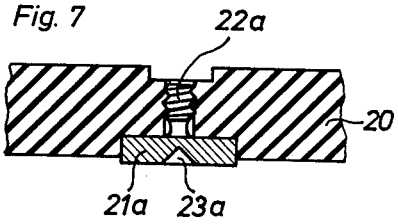
Fig. 5
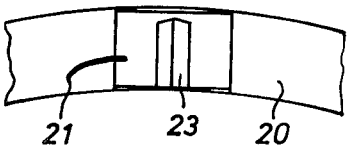
Fig. 8
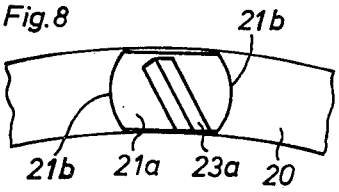

CENTRIFUGE WITH SLUDGE OUTLETS AT ROTOR PERIPHERY

This invention relates to centrifugal separators of the type in which the rotor has peripheral outlets for discharging separated sludge.

For centrifugal separation of sludge from sludge-containing liquids, there are several kinds of centrifugal separators. The kind chosen for a particular separation depends on various factors, such as the sludge concentration of the sludge-containing liquid, the consistency of the separated sludge and/or the size of the particles (or possibly aggregates of particles) prevailing in the sludge separated by the centifugal separation.

So-called nozzle centrifuges normally are used when the sludge content in the liquid is relatively high and the particle size in the separated sludge is relatively small. If the particle size is too large, a so-called decanter centrifuge can be used instead, wherein a conveyor screw is arranged for discharging from the centrifuge rotor the sludge that has been separated. However, a decanter centrifuge does not have as good separation properties as a nozzle centrifuge, as it cannot be rotated with the same high velocity; and therefore it is attempted to use a kind of centrifugal separator with intermittent discharge of separated sludge through relatively large outlet openings at the periphery of the centrifuge rotor.

In this last-mentioned kind of centrifugal separator, there is an annular slide member arranged for closing or opening the peripheral sludge outlet openings by being axially displaceable during operation of the centrifugal separator to or from abutment against a part of the centrifuge rotor, either radially inside or radially outside the sludge outlet openings. The separation properties of this kind of centrifugal separator are very good, but for technical and other reasons the frequency of the sludge discharge operations which can be performed is limited. This means that the concentration of sludge in the liquid to be centrifuged cannot be particularly large, if this kind of centrifugal separator is to be used.

Of course, centrifugal separators of this last-mentioned kind can be used also in cases where the sludge content in the liquid is very high, but then only a very small amount of liquid per unit of time can be treated in each centrifugal separator. This means that each centrifugal separator must be operated with a very low capacity, which in turn means that for a certain separation, a relatively large number of centrifugal separators must be provided.

When a particular kind of centrifugal separator must be chosen for a certain separation, centrifugal separators with intermittently openable, relatively large sludge outlets often cannot be used, since the sludge content in the liquid to be treated is too high. Perhaps it can also be seen that not even a certain suitable size of a nozzle centrifuge can be used, since the nozzle openings thereof, which would have to be dimensioned in a certain way to continuously let through the correct amount of separated sludge per unit of time, are too small to avoid clogging thereof. The separated sludge either may contain relatively large particles or have a tendency to successively clog the nozzle openings.

One attempt to resolve a problem of this kind resides in a reduction of the number of sludge outlet nozzles, so that the outlet area of each nozzle can be increased. This possibility of resolving the problem is limited, however, for if the distance between the nozzles is too large, sludge will collect between the nozzles within the separating chamber of the rotor, thereby causing problems of different kinds. The normal use of filler-pieces between the nozzles at the periphery of the separating chamber can be inadequate to avoid this sludge collection, as the filler-pieces must not extend too long radially inwards in the separating chamber. In practice, filler-pieces of this kind cannot be allowed to extend even half-way radially inwards towards the so-called disc set normally present in a centrifugal separator of this kind, since the filler-pieces would then take up too large a part of the separating chamber of the centrifuge rotor.

If this attempt at resolving the problem is not successful, another kind of centrifugal separator will have to be chosen, such as a decanter centrifuge. However, as previously mentioned, decanter centrifuges do not have as good separation properties as nozzle centrifuges and intermittently sludge discharging centrifuges. Furthermore, decanter centrifuges are not suitable for separation in cases where a part of the separated sludge has a slippery consistency and appears substantially as a liquid.

The latter cases of difficult separation often appear within the more and more expanding field of waste water treatment. The liquids common in this field contain both relatively large particles and slippery sludge which is more or less fluent. Further, sludge of the last-mentioned kind often has almost the same density as the liquid from which it should be separated, and consequently separation of the sludge requires a centrifugal separator which can subject the liquid to the strongest possible field of centrifugal force.

The principal object of the present invention is to solve problems of the above-described kind. This can be done by means of a centrifugal separator in which the rotor has a central inlet for a sludge-containing liquid, a central outlet for separated liquid, and several peripheral outlet openings for separated sludge, the centrifugal separator being characterized in that the sludge outlet openings are formed by and between two parts of the rotor, at least one of which rotor parts is axially displaceable during operation of the centrifugal separator to and from abutment against the other.

In a centrifugal separator of this kind, there is formed around the entire periphery of the centrifuge rotor a continuous opening or slot, when the two rotor parts are moved axially apart from each other. Upon a movement of this kind during the operation of the centrifugal separator, separated sludge is discharged through the whole of this slot, the sludge outlet openings of the rotor then being automatically cleaned from sludge particles which have blocked the same. With this intermittent cleaning of the ordinary sludge outlet openings, it is possible in connection with many separation cases to use a centrifugal separator which can subject the treated liquid to a strong field of centrifugal force even though the liquid has both a high sludge content and a content of relatively large particles.

It should be mentioned in this connection that there is available on the market a kind of centrifugal separator in which the rotor has two different kinds of peripheral outlets for sludge separated from a liquid supplied to the motor. The centrifuge rotor has both conventional, constantly open nozzles and an axially displaceable slide member which is arranged for intermittent opening of separate peripheral outlets. However, a centrifugal separator of this kind (see, for instance, British Pat. No.

1,325,413) cannot be used for a difficult separation of the above-described kind, because if one or more of the nozzles of a centrifugal separator of this kind is clogged by sludge particles, the centrifugal separator must be taken out of operation for manual cleaning exactly as any other nozzle centrifuge of a conventional kind.

Centrifugal separators of this known kind are presently used in connection with separation of yeast, cottage cheese and other kinds of "sludge", in which there are no large particles which can clog the nozzles.

In the use of a centrifugal separator according to the present invention, it may be necessary to provide the two abutting surfaces of the two rotor parts (and also the surfaces defining the sludge outlet openings) with a layer of a suitable material for protecting against erosion. The sealing ring normally present between the rotor parts in a centrifugal separator of this general kind (see the above-mentioned British patent) may be replaced by a ring of harder material, and also the rotor part which is to abut against a ring of such harder material may be provided with an erosion-resistant layer of suitable material. With these measures, the possibility of complete sealing between the rotor parts may be lost in the areas between the sludge outlet openings. However, this often does not matter in practice, since separated sludge will seal between the rotor parts during the larger part of a separating operation.

In a preferred embodiment of the centrifugal separator according to the invention, separate means are arranged for protecting against erosion at the sludge outlet openings, at least in one of the annular parts of the rotor, each of which means rests axially against a flexible support in the annular rotor part, for instance, a piece of relatively soft material such as plastic or rubber, and is arranged to abut against the other annular rotor part and form therewith one of said sludge outlet openings. This arrangement of separate means constitutes a simple and relatively inexpensive solution of the problem with erosion around the sludge outlet openings, and it also makes it simple to adapt a centrifugal separator of the kind involved here to the particular operational conditions under which it is to work, i.e., to provide the centrifugal separator with an optimum number of sludge outlet openings each with an optimum size of the through-flow area.

With the arrangement of the separate means, it is also possible to maintain a sealing ring of relatively soft material along the rotor periphery, so that an effective sealing may be maintained between the separate sludge outlet openings. It is also possible to overlay one of the rotor parts along the whole of its periphery with a layer of very hard material without any risk of this layer cracking when the two rotor parts are brought to abutment against each other.

Due to the fact that the separate means are resting against a flexible support, they will automatically adapt themselves (as to their axial position) to the sealing surface between the two annular rotor parts. Since the sealing ring consists of relatively soft material, the sealing surface will move perhaps a tenth of a millimeter during the operation of the centrifugal separator; in other words, the sealing ring will be stamped by the other rotor part. Because of the separate means of hard material resting on a flexible support, this support will be stamped to the same extent as the sealing ring. In this manner sealing problems are avoided in spite of the arrangement of separate means of hard material along the sealing surfaces of the rotor parts.

According to a preferred embodiment of the invention, the separate means are situated in recesses in a conventional sealing ring of the above-mentioned kind, parts of this sealing ring constituting said flexible support for the separate means.

According to a further development of the invention, separate means of the described kind are arranged opposite to each other in both of the annular rotor parts. An arrangement of this kind may be necessary in connection with separation of exceptionally erosive sludge types in a centrifugal separator of the kind wherein the two rotor parts during operation are intermittently moved axially from each other for discharge of sludge collected in the areas between the continuously open sludge outlet openings. In this connection, it may be necessary to refrain from using a conventional sealing ring of relatively soft material between the rotor parts. It is possible in such cases, however, to make the main part of the annular rotor parts of relatively inexpensive material so that only the separate means are made of an extremely erosion-resistant and thus relatively expensive material. Of course, the areas around the continuously open sludge outlet openings are more subjected to erosion than the abutment surfaces of the rotor parts between the sludge outlet openings.

The invention will be described in more detail below with reference to the accompanying drawings, in which FIG. 1 is a vertical sectional view of a centrifuge rotor of the kind involved here;

FIG. 2 is a detailed sectional view of a part of the rotor periphery with a first embodiment of the invention;

FIG. 3 is a sectional view along the line III—III in FIG. 2;

FIG. 4 is a view similar to FIG. 3 but with the arrangement only partly assembled;

FIG. 5 is a view of the arrangement shown in FIG. 4, as seen from below;

FIGS. 6, 7 and 8 are views of a second embodiment of the invention, these views corresponding to FIGS. 3, 4 and 5, respectively;

Figure 1:
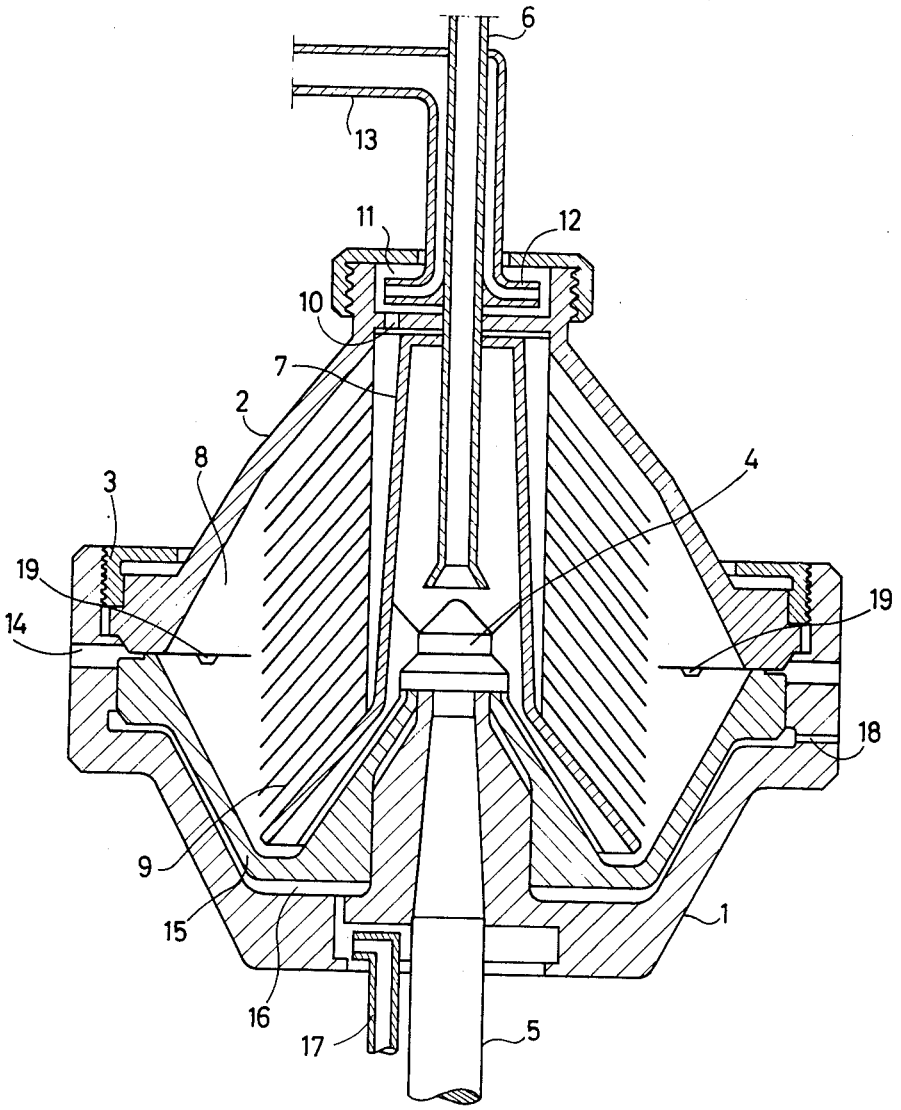
Figure 10:
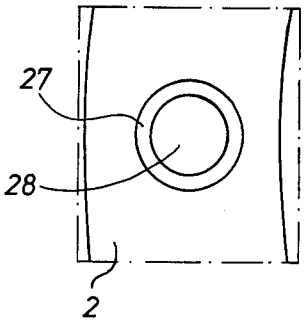
FIG. 10 is a view along the line X—X in FIG. 9.

In FIG. 1 there is shown a centrifuge rotor consisting of a lower part 1 and an upper part 2, which parts are kept together by a locking ring 3. The centrifuge rotor is fastened by means of a screw nut 4 to a driving shaft 5. Through a stationary inlet conduit 6, sludge-containing liquid to be treated in the rotor is directed to the center of the rotor. By a conical distributor 7, the liquid is conducted from the center of the rotor into the lower part of its separating chamber 8. From this chamber, liquid separated during the separating operation flows radially inward between the discs in a conical disc set 9 and thence through an opening 10 into a paring chamber 11. From this chamber 11, the liquid is removed from the rotor by means of a stationary paring means 12 leading to a conduit 13. Separated sludge which is heavier than the liquid remains in the separating chamber 8 and forms a layer in the radially outermost part thereof.

The lower rotor part 1 has a number of ports 14 spaced around its periphery and constituting outlet openings for the sludge separated in the rotor. Radially inside the ports 14 there is arranged a third rotor part 15 which is axially displaceable relative to the rotor parts 1 and 2. This third rotor part 15 forms a bottom of the separating chamber 8, and its periphery can be kept in abutment against the underneath side of the upper rotor part 2 by means of a liquid pressure. This liquid pressure is created by constant supply of liquid to an interspace 16 below the rotor part 15 between the latter and the lower part 1 of the rotor body. A stationary pipe 17 is shown for supplying liquid to the interspace 16, which is provided with a peripheral drainage channel 18.

Along its periphery, the third rotor part 15 has several grooves which, when the rotor part 15 abuts against the upper rotor part 2, form channels 19 through the surrounding wall of the centrifuge rotor. Channels of this kind, alternatively, may be provided by grooves in the upper rotor part 2, or by grooves in both rotor parts 2 and 15. Grooves in the rotor part 2 do not necessarily have to be situated axially opposite grooves in the rotor part 15.

In FIG. 2 there are shown portions of the rotor parts 2 and 15 and also a sealing ring 20 of relatively soft material arranged in an annular groove in the rotor part 2. Also, as shown in FIG. 2, means consisting of a plate 21 and a pin 22 are arranged in a recess in the sealing ring 20. The plate 21 has a groove 23 which, when the rotor parts 2 and 15 are brought into abutment against each other, forms a channel corresponding to a channel 19 in FIG. 1. The pin 22, which has a narrow portion 24, extends through a hole in the sealing ring 20 and thence for a distance into a hole in the rotor part 2.

In FIG. 4, the plate 21 is shown located in a previously formed recess in the sealing ring 20. As can be seen from FIG. 4, this recess in the sealing ring 20 is somewhat shallower than the thickness of the plate 21. In FIG. 4, the plate 21 is shown after it has been subjected to a relatively large axial force, so that its lower surface is situated in the same plane as the sealing surface of the sealing ring 20. Thus, the soft material of the sealing ring has partly adapted itself to the shape of the pin 22, so that the pin 22 and also the plate 21 are maintained in a desired position relative to the sealing ring 20, even when one of the rotor parts 2 and 15 is retracted axially from the other.

Referring to FIGS. 6–8, showing an alternative embodiment of the arrangement according to FIGS. 3–5, the plate **21*a* has a groove 23*a* forming an angle with one radius of the centrifuge rotor. The purpose of this angle is to avoid, as much as possible, losses of force when sludge is leaving the centrifuge rotor, during operation, through the peripheral sludge outlet openings 19 (see FIG. 1). Further, the plate 21*a* has partly arcuate edges 21*b*, so that by means of threads 25 on pin 22*a* the plate 21*a* may be screwed into a recess formed by drilling in the sealing ring 20. The final fastening of the plate 21*a* and pin 22*a* relative to the sealing ring 20 may be performed in the same way as the final fastening of the plate 21 and the pin 22 according to FIG. 3. When the plate 21*a* has been pressed into its final position in the sealing ring 20, as shown in FIG. 6, and the sealing ring 20 is situated in its annular groove in the rotor part 2 (see FIG. 2), undesired turning of the plate 21*a* is prevented by the rotor part 2**.

In FIGS. 9–12 there is shown an embodiment of the invention in which the centrifuge rotor has no conventional sealing ring of relatively soft material (such as sealing ring 20 in FIGS. 2–8) between the rotor parts 2 and 15. In this case, in the areas of the peripheral sludge outlet openings 19 (see FIG. 1), each of the rotor parts 2 and 15 has a separate means resting axially against a flexible support. Thus, each sludge outlet opening is formed by and between two separate means arranged opposite to each other in the respective rotor parts 2 and 15. Of course, in this case it is necessary that the rotor parts 2 and 15 be guided against rotation relative to each other, so that the rotor part 15 cannot turn relative to the rotor part 2 around the axis of the rotor. Guidance of this kind (not shown in the drawing) can be performed in a conventional manner either at the center or at the periphery of the centrifuge rotor.

Figure 9:
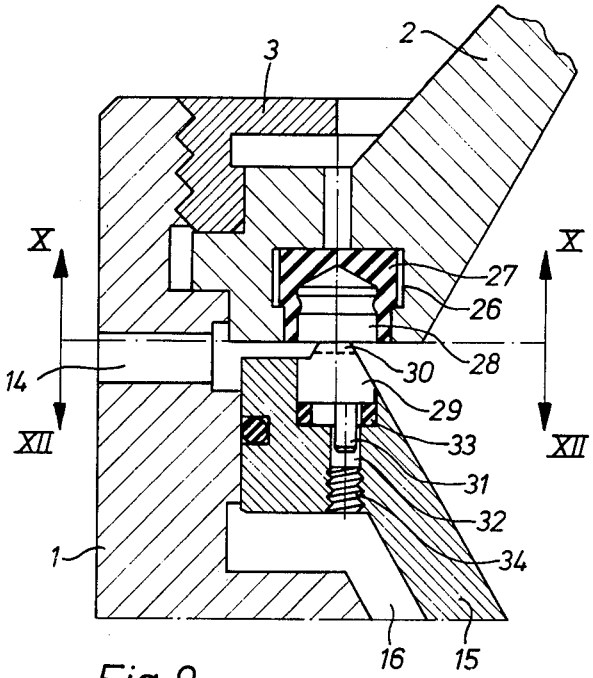
FIG. 9 is a sectional view of part of the rotor periphery with a third embodiment of the invention.
Figure 11:
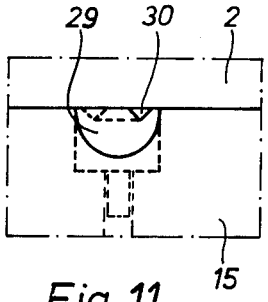
FIG. 11 is a view of the arrangement in FIG. 9 as seen from the right in this figure.
Figure 12:
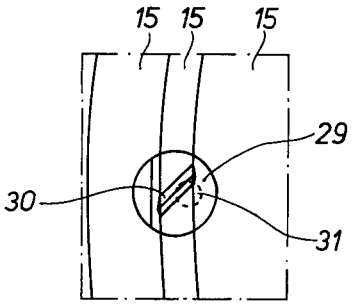
FIG. 12 is a view along the line XII—XII in FIG. 9.

As shown in FIG. 9, there is arranged in a recess 26 in the rotor part 2 a body 27 of relatively soft material, such as polyamide plastic. Embedded in this body 27 is a smaller body 28 of very erosion-resistant material. The assembly of the bodies 27 and 28 is performed in a way such that the body 27 is first inserted into the recess 26, the diameter of which close to its opening is substantially the same as the outer diameter of the prefabricated body 27. The body 28 of hard material is then inserted into a recess in the body 27, said recess in the body 27 being originally too shallow to receive the whole body 28. When the hard body 28 has been inserted to the bottom of the recess in the soft body 27, a force is applied to the hard body 28 so that the material of the soft body 27 is subjected to plastic deformation and partly fills the inner part of the recess 26, which has a somewhat larger diameter, as shown in FIG. 9.

In the rotor part 15 (FIG. 9) there is arranged another body 29 of hard material opposite the hard body 28. This hard body 29 has a groove 30 which forms a sludge outlet during operation of the centrifuge rotor. The groove 30 can best be seen in FIG. 12.

The hard body 29 is inserted into a cylindrical recess in the rotor part 15 and has a pin 31 extending a distance through a narrow hole 32 in the rotor part 15. The hole 32 is situated eccentrically in relation to said cylindrical recess in the rotor part 15, so that turning of the body 29 is prevented. Between the body 29 and the bottom of the cylindrical recess in the rotor part 15 is an annular body 33 of elastic material. The hole 32 is plugged by a threaded plug 34 to prevent liquid from finding its way into the hole 32 from the space 16 below the rotor part 15.

As is apparent from the above, the material of the sealing ring 20 (FIGS. 2–8) as well as each body 27 (FIG. 9) should be plastically deformable. However, it should also be elastically deformable to some extent so that it is resilient and thereby ensures that the rotor parts 2 and 15 will be brought into abutment against each other around the whole periphery of the rotor, i.e., in the areas around the sludge openings as well as between these areas. Even the material in each body 33 should be elastically deformable. A material which has proved by testing to have the desired properties is the one presently used for conventional sealing rings corresponding to the sealing ring 20.

In the arrangement according to FIGS. 9–12, it is suitable that at least one of the hard bodies 28 and 29 projects somewhat beyond the sealing surface of the respective rotor part before these rotor parts have been brought into abutment with each other. This ensures that contact will be achieved between the bodies 28 and 29 and that these will be kept abutting against each other by a certain force.

It will be understood that each of the sludge outlet openings 19 (FIG. 1) is formed by the groove 23 in FIGS. 2–5 or by the groove 23*a* in FIGS. 6–8 or by the groove 30 in FIGS. 9–12. In normal operation of the centrifuge, the rate of liquid supply through pipe 17 is sufficient to maintain interspace 16 substantially filled with the liquid, whereby the annular rotor part 15 is held against the annular lower surface of rotor part 2. In this condition, separated sludge is discharged from separating chamber 8 through the peripheral outlet openings 19 and thence through the larger outlet openings 14 in the periphery of the rotor housing 1–2. When the rate of liquid supply through pipe 17 is reduced sufficiently to substantially empty the interspace 16, the rotor part 15 is forced downward to form with rotor part 2 an opening or slot extending continuously around the entire periphery of the rotor. The resulting heavy discharge of separated sludge through this slot acts to flush away any sludge particles which have blocked the grooves forming the outlet openings 19, so that the latter are cleared for normal discharge of sludge when rotor part 15 is returned into abutment with rotor part 2.

We claim:

1. In a centrifugal separator, a rotor mounted for rotation about an axis and having a central inlet for a sludge-containing liquid and a central outlet for separated liquid, the rotor including two parts of which at least a first part is axially displaceable into and from abutment against a second part during operation of the centrifugal separator, the rotor also having a plurality of peripheral outlet openings for separated sludge, said sludge outlet openings being formed by and between said two parts of the rotor.

2. The rotor of claim 1, in which said rotor parts have respective surfaces which come into contact with each other when said first part is displaced into said abutment against the second part, said surface of one rotor part having grooves constituting said sludge outlet openings, said surface of the other rotor part being substantially smooth.

3. The rotor of claim 2, in which said surface of at least one of said rotor parts is at least partly formed by an erosion-resistant material.

4. The rotor of claim 1, in which the rotor comprises a housing provided with an annular portion and having peripheral openings in addition to said outlet openings, said first part of the rotor being axially displaceable into and from abutment with said annular portion of the housing, said first part and said annular portion forming said outlet openings when in said abutment with each other and forming a continuous opening around the periphery of the rotor when separated from each other.

5. The rotor of claim 4, in which said housing forms a separating chamber, said first rotor part being a sliding member forming an end wall of the separating chamber, said second part of the rotor forming the opposite end wall of the separating chamber.

6. The rotor of claim 1, comprising also separate erosion-resistant means at each of said sludge outlet openings and located in at least one of said rotor parts, and a flexible element supporting each of said separate means and located in said one part of the rotor, the other part of the rotor being engageable with each of said separate means to form therewith one of the sludge outlet openings.

7. The rotor of claim 6, in which said separate means have respective grooves forming said sludge outlet openings.

8. The rotor of claim 6, in which each of said separate means includes a plate and a pin connected to the plate, said plate being located between said rotor parts and contacting both of said parts when said parts engage each other, said flexible element having a hole through which said pin extends.

9. The rotor of claim 8, in which said pin has at least one portion which is narrower than other portions of the pin.

10. The rotor of claim 8, in which the pin has threads along part of its length.

11. The rotor of claim 8, in which said one rotor part has recesses for the respective plates, each plate having arcuate peripheral portions permitting rotation of the plate in its recess to secure the plate.

12. The rotor of claim 11, in which said one rotor part has surfaces defining an annular groove and includes a separate ring inserted in said groove, said recesses being formed in said ring and permitting rotation of each plate in its recess before the ring is inserted in said groove, said groove-defining surfaces preventing said rotation when the ring is inserted in said groove.

13. The rotor of claim 6, in which said one rotor part has cylindrical recesses for the respective separate erosion-resistant means, said one rotor part also having a hole at the bottom of each said recess and eccentric thereto, each said separate means having a detent extending into a said hole to prevent rotation of the separate means in its recess.

14. The rotor of claim 6, in which said flexible element is resilient.

15. The rotor of claim 6, in which said flexible element is elastically deformable.

16. The rotor of claim 6, in which said one rotor part includes a sealing ring engageable with the other rotor part when said parts abut each other, said sealing ring having parts forming the respective flexible elements.

17. The rotor of claim 6, in which said separate erosion-resistant means are arranged in opposing pairs in the respective rotor parts, said parts having hard surfaces adapted to abut directly against each other between said opposing pairs.

* * * * *